United States Patent [19]

Oberbach et al.

[11] Patent Number: 4,593,838

[45] Date of Patent: Jun. 10, 1986

[54] APPARATUS FOR REPLACEABLY CONNECTING A CASTING TUBE TO A CLOSABLE POURING SPOUT OF A TUNDISH

[75] Inventors: Manfred Oberbach; Laurenz Keisers, both of Krefeld, Fed. Rep. of Germany

[73] Assignee: Didier-Werke AG, Wiesbaden, Fed. Rep. of Germany

[21] Appl. No.: 641,290

[22] Filed: Aug. 16, 1984

[30] Foreign Application Priority Data

Sep. 7, 1983 [DE] Fed. Rep. of Germany ..... 3332186

[51] Int. Cl.[4] ..... B22D 35/00; B67D 3/00; B65B 1/04; G05G 1/04

[52] U.S. Cl. ..... 222/607; 222/533; 141/387; 74/522

[58] Field of Search ..... 222/591, 607, 606, 600, 222/533; 164/337, 437; 74/522; 141/387, 388, 231, 233, 232; 285/309, 310; 266/265, 266

[56] References Cited

U.S. PATENT DOCUMENTS

| | | | |
|---|---|---|---|
| 4,222,505 | 9/1980 | Daussan et al. | 222/600 |
| 4,262,827 | 4/1981 | De Masi et al. | 164/337 X |
| 4,316,561 | 2/1982 | Grosko | 222/606 |
| 4,381,102 | 4/1983 | King | 222/607 X |
| 4,402,437 | 9/1983 | Fortner et al. | 222/607 |
| 4,550,867 | 11/1985 | Bell et al. | 222/607 |

FOREIGN PATENT DOCUMENTS

| | | | |
|---|---|---|---|
| 874886 | 7/1971 | Canada | 222/607 |
| 2621557 | 4/1977 | Fed. Rep. of Germany | 164/337 |
| 7229792 | 3/1974 | France | 164/337 |
| 55-88975 | 5/1980 | Japan | 164/437 |

*Primary Examiner*—Stanley H. Tollberg
*Assistant Examiner*—Gregory L. Huson
*Attorney, Agent, or Firm*—Wenderoth, Lind & Ponack

[57] ABSTRACT

An apparatus for replaceably connecting a casting tube to a closable pouring spout of a tundish includes a gimbal device for supporting the casting tube and a double-arm lever including a first arm supporting the gimbal device and a second arm carrying a counterweight. The lever is supported about an axis such that the counterweight pivots the lever about the axis and causes the first arm and the gimbal device to press the casting tube against the mouth of the pouring spout. Supports are fixed to the tundish, a pin member defines the axis, and a mounting structure moves the pin member between an operative position pivotally supporting the lever on the supports and an inoperative position where the lever is released from the supports.

13 Claims, 6 Drawing Figures forked head portion having a pair of legs extending along opposite sides of the plate member, the bolt extending through such legs and the third slot, with the head portion being guided along an end face of the plate member. The head portion may abut one of the plate-like supports when the pin member is in the operative position thereof. The pin member may include an end portion opposite the head portion, such end portion extending beyond the other plate-like support when the pin member is in the operative position thereof. The lock means may comprise a fourth slot extending through the end portion, and a key member driven into the fourth slot and wedged between the pin member and the other plate-like member.

In accordance with a further advantageous feature of the present invention, there is provided means for, upon the pin member being in the inoperative position thereof, enabling the second arm of the lever to be pivoted against the counterweight, such that the first arm and the gimbal device are moved away from the pouring spout, whereby a spent casting tube may be removed and/or a new casting tube may be installed. This means may comprise parallel guide rails fixed on the tundish on opposite sides of the pouring spout, and shaft portions extending transversely of the lever at a location on the pivot means side of the gimbal device, thereby supporting the lever on the guide rails for longitudinal movement therealong, and forming a further axis for pivoting of the gimbal device away from the pourting spout against the force of the counterweight. The second arm of the lever preferably is in the form of a forked structure having a pair of spaced parallel legs extending on opposite sides of and supporting the gimbal device, the shaft portions extending outwardly from respective of these legs and riding on respective of the guide rails.

BRIEF DESCRIPTION OF THE DRAWINGS

Other objects, features and advantages of the present invention will be apparent from the following detailed description of a preferred embodiment thereof, with reference to the accompanying drawings, wherein.

DETAILED DESCRIPTION OF THE INVENTION

Figure 1:
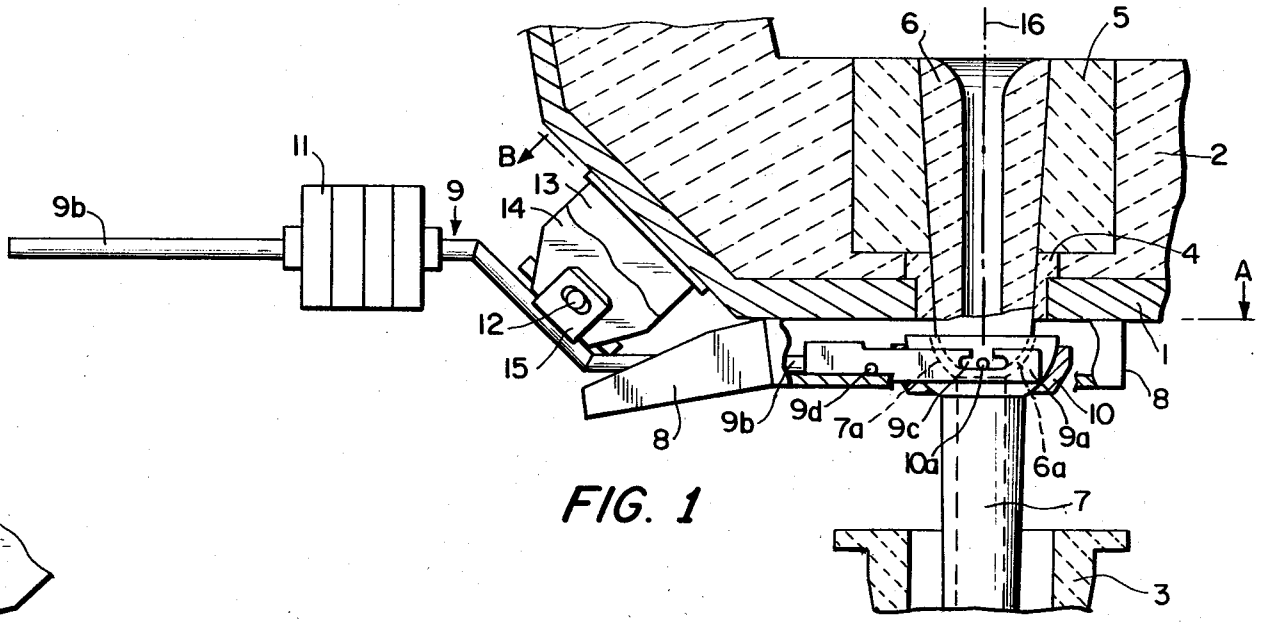
FIG. 1 is a cross section through the spout of a tundish to which is attached an apparatus according to the present invention.
Figure 2:
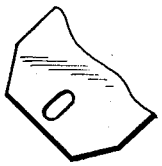
FIG. 2 is a fragmentary view of a portion of a plate-like support removed from the illustration of FIG. 1.
Figure 4:
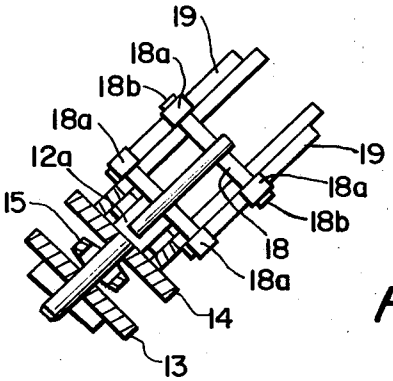
FIG. 4 is a partially sectioned view taken along the plane B of FIG. 1.
Figure 3:
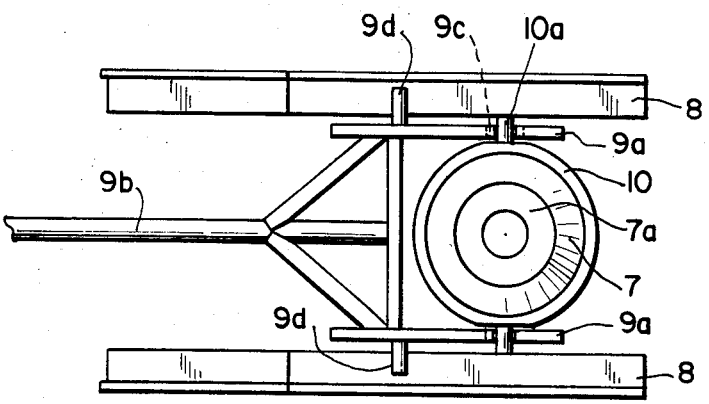
FIG. 3 is a top plan view of a portion of the apparatus of FIG. 1, taken along the plane A of FIG. 1.

Shown in FIG. 1 is a portion of a tundish including an outer metal bottom 1 and a refractory lining 2. The bottom 1 is perforated to provide a spout area and is provided thereat with a ceramic collar 4 projecting toward the tundish interior and toward which a ladle sleeve 5 and a spout 6 are directed. The spout 6 has at an outer end portion thereof a spherical head portion 6*a* against which is mounted a seat 7*a* having a complementary profile of a casting tube 7. During a continuous casting operation, as will be understood by those skilled in the art, molten metal, for example steel, is discharged through spout 6 and casting tube 7 into a permanent ingot mold 3. These elements are intended to be of conventional design and structure.

Beneath metal bottom 1 are mounted a pair of parallel tracks or guide rails 8, for example formed of angle members, in a location to receive therebetween the spout 6. A lever 9 includes a first arm 9*a* in the form of a forked structure having a pair of spaced parallel legs extending on opposite sides of and supporting a gimbal device 10 by suspension pins 10*a* thereof fitting in recesses 9*c* of the legs of lever arm 9*a*. The lever 9 includes a second arm 9*b* supporting thereon a counterweight 11. Gimbal device 10 is profiled to support the head of casting tube 7, and the lever is mounted in an arrangement whereby the counterweight 11 pivots the first arm 9*a* and the gimbal device 10 in a counterclockwise direction as shown in FIG. 1 to press the casting tube 7 against the spherical head 6*a* of spout 6, with a known special mortar (not shown) provided therebetween.

Figure 5:
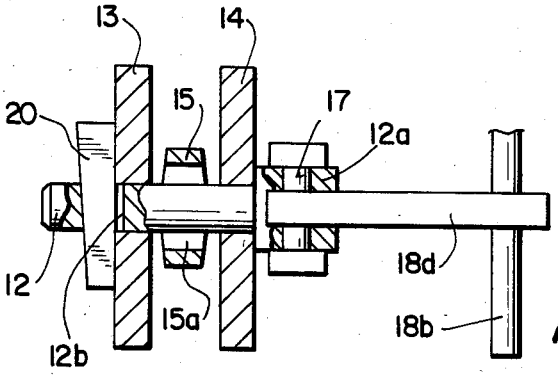
FIG. 5 is an enlarged view of a portion of the structure shown in FIG. 4.
Figure 6:
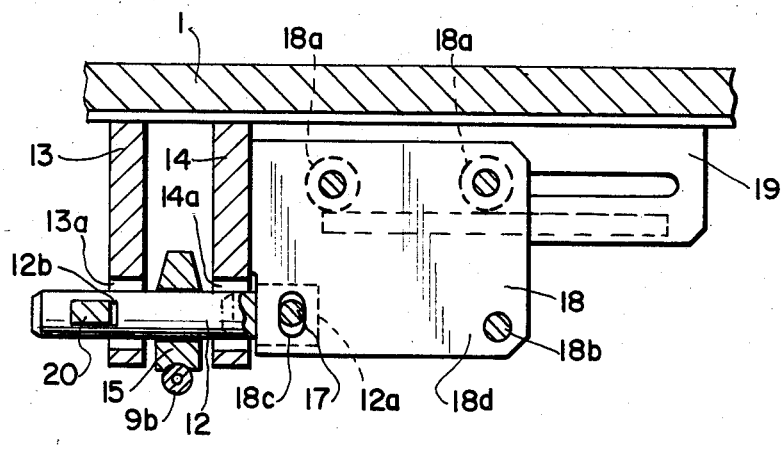
FIG. 6 is an enlarged side view of a portion of the structure shown in FIG. 4.

In accordance with the present invention, there is provided a pivot arrangement to support lever 9 such that counterweight 11 causes such pivoting movement of lever 9 about a pivot axis to cause first arm 9*a* and gimbal device 10 to press the casting tube 7 against the mouth of pouring spout 6. This pivot arrangement includes support means in the form of plate-like supports 13, 14 fixed to the tundish bottom to extend therefrom in spaced parallel relationship. Each plate-like support 13, 14 has therein a respective first slot 13*a*, 14*a* elongated in a direction transverse to the axis about which pivots the lever 9. A pin member 12 defines such pivot axis and is mounted to move between an operative position pivotally supporting lever 9 on support means 13, 14, as shown in FIG. 6, and an inoperative position whereat the lever is released from support means 13, 14. FIG. 6 illustrates by partial phantom lines the inoperative position of pin member 12, at least the left-most end thereof. A bearing member 15 is fixed to lever 9 and has therethrough a second slot 15*a* (FIG. 5) elongated in a direction transverse to the axis of pin member 12 and generally orthogonal to the directions of elongation of first slots 13*a*, 14*a*. This manner of orientation of slots 13*a*, 14*a*, 15*a* provides a free suspension of lever 9 to provide for precise centering of casting tube 7 against spout 6. In other words, these slots enable pivoting motion of lever 9 in such a manner as to allow motion of the lever and thereby the casting tube in small amounts to the left and right as shown in FIG. 1 to achieve proper centering of surfaces 6*a*, 7*a*. Furthermore, bearing member 15 is positioned between plate-like supports 13, 14 (FIG. 6) with limited play therebetween to enable lateral motion of lever 9 to achieve proper centering of surfaces 6*a*, 7*a* in directions transverse to the plane of FIG. 1.

The pin is connected to a trolley member 18, preferably in the form of a plate member having rollers 18*a* suspending the plate member from guide rails 19 fixed to tundish bottom 1 in spaced parallel relationship in directions extending parallel to the axis of pin member 12. Thus, movement of trolley member 18 to the right and left as viewed in FIG. 6 along rails 19 will move pin member 12 to the inoperative and operative positions thereof. A handle 18*b* may be provided on plate member 18*d* to enable easy manual movement. Plate member 18*d* has therein an orifice in the form of a third slot 18*c* elongated in a direction parallel to the directions of elongation of slots 13*a*, 14*a* as shown in FIG. 6. Pin

APPARATUS FOR REPLACEABLY CONNECTING A CASTING TUBE TO A CLOSABLE POURING SPOUT OF A TUNDISH

BACKGROUND OF THE INVENTION

The present invention relates to an apparatus for replaceably connecting a casting tube to a closable pouring spout of a tundish of a continuous casting plant, particularly for the continuous casting of metal bars of small cross sections, wherein the casting tube extends into a permanent ingot mold to maintain molten metal being discharged from the pouring spout out of contact with the surrounding air. More particularly, the present invention relates to such an apparatus of the type including a gimbal device for supporting the casting tube and a double-arm lever including a first arm supporting the gimbal device and the casting tube and a second arm carrying a counterweight, the lever being pivoted about an axis such that the first arm and the gimbal device press the casting tube against the mouth of the pouring spout.

It is common practice to employ a casting tube on the spout of a tundish to protect the molten metal being discharged from the tundish from being oxidized on its way to a mold and to enable the molten metal to be poured quietly and distributed uniformly across the cross section of the mold. During such process, the casting tube, formed of a refractory material, is subjected to enormous thermal, erosive and chemical attacks. Such casting tubes therefore wear rapidly and must be replaced often during the life of the other elements of the casting operation, and particularly must be replaced within the casting times possible for sequence casting, particularly during continuous casting. The replacement of a casting tube that has become useless through wear must be effected rapidly and reliably to maintain the continuous casting formation in the mold.

Counterweight devices of this general type that function according to the principle of a counter fastening of the casting tube to the spout by means of a two-arm lever, unlike cotter or bayonet-type fittings, enable a simple mounting and removal of the casting tube, and thereby provide for a rapid exchange or replacement of the casting tube, generally known as a "flying exchange", when interrupting the casting operation in a continuous casting sequence. Presently, such known devices mainly are employed in continuous casting plants using permanent ingot molds with a relatively small cross section. In such operations, chilling of the molten metal, for example steel, and thereby slag formation on the casting tube that dips into the molten steel, cannot be ruled out. When such occurs, a removal force can be transmitted from the cast bar through the casting tube to the counterweight, with the result that the casting tube will be released from the spout against the force of the counterweight. A gap results, through which the molten metal is forced outwardly before a stopper of the tundish is closed. This creates the danger of an accident and can lead to considerable damage.

SUMMARY OF THE INVENTION

With the above discussion in mind, it is the object of the present invention to provide an apparatus for replaceably connecting a casting tube to a closable pouring spout of a tundish, by which it is possible to overcome the above and other prior art disadvantages, and to make the apparatus safe, practical and easy to operate.

This object is achieved in accordance with the present invention by providing an apparatus of the type discussed above, and including pivot means for supporting the lever such that the counterweight pivots the lever about an axis and causes the first arm and the gimbal device to press the casting tube against the mouth of the pouring spout, the pivot means comprising support means adapted to be fixed to the tundish, a pin member defining the axis, and mounting means for moving the pin member between an operative position pivotally supporting the lever on the support means and an inoperative position whereat the lever is released from the support means. Further, there is provided lock means for holding the pin member in the operative position. By the provision of an apparatus of this type, the forces that pull on the casting tube against the counterweight during operation no longer will swivel the lever, and thus cannot prevent the casting tube from being pressed against the spout. On the contrary, the position and manner of connection of the pin member is fixed in such a way that the contact pressure between the mouth of the pouring spout and the casting tube is maintained, and the casting tube no longer can be moved away from the mouth of the pouring spout once the counterweight becomes effective. This arrangement results in a device that is safe to operate and which can be manipulated quickly and easily, for example for the replacement of the casting tube. Better handling can be achieved when the lever includes arms of unequal length, including a shortened lever arm supporting the casting tube and pivotally and slidably supported on guide rails fixed to the tundish, such supporting being by means of transverse shaft portions.

The support means has therein orifices through which extends the pin member in the operative position thereof. Such orifices comprise first slots elongated in directions transverse to the axis. Also, an orifice is provided on the lever and through which extends the pin member in the operative position thereof, and such orifice of the lever comprises a second slot elongated in a direction transverse to the axis and generally orthogonal to the directions of elongation of the first slots in the support means.

In a preferable arrangement, the support means comprises a pair of plate-like supports fixed to the tundish and extending therefrom in spaced parallel relationship, each such plate-like support having therein a respective first slot. Also, a bearing member is fixed to the lever and has therethrough the second slot, the bearing member being positioned between the plate-like supports when the pin member is in the operative position thereof. The mounting means comprises a trolley member connected to the pin member and mounted for movement in opposite directions parallel to the axis toward and away from the plate-like supports. Such trolley member preferably may comprise a plate member adapted to be suspended from the tundish by rollers moving on guide rails extending parallel to the axis. A handle may extend from the plate member to enable manual movement thereof along the guide rails. The plate member may have therein an orifice, with a bolt extending through the orifice to removably connect the pin member to the plate member. This orifice in the plate member may comprise a third slot elongated in a direction parallel to the directions of elongation of the first slots. The pin member preferably has an integral member 12 has an integral forked head portion 12*a* having legs extending along opposite sides of the plate member 18*d*. A bolt 17 extends through these legs and slot 18*c*, head portion 12*a* being guided along an end face of plate member 18*d*. As shown in FIG. 6, head portion 12*a* abuts one plate-like support 14 when the pin member is in the operative position thereof. As also shown in FIG. 6, pin member 12 includes an end portion opposite the head portion 12*a* and extending beyond the other plate-like support 13 when the pin member is in the operative position thereof. There is provided lock means for holding pin member 12 in the operative position. This lock means comprises a fourth slot 12*b* extending through the end portion of the pin member, and a key member 20 driven in to the fourth slot and wedged between the pin member 12 and plate-like support 13.

The apparatus of the invention is operated in the following manner.

When it becomes necessary to replace a casting tube when the apparatus is in the operative position shown in FIG. 1, spout 6 first is closed by a stopper, not shown for simplicity of illustration. Key member 20 then is driven from slot 12*b*. Handle 18*b* is employed to move trolley 18 to the inoperative position, i.e. to the right as shown in FIG. 6. Thus, the trolley 18 essentially acts as a quick or snap fastening and unfastening device for pin member 12. When the pin member is moved to the inoperative position thereof, lever arm 9*b* may be raised against the force of counterweight 11. When this happens, the lever 9 then is pivoted about shaft portions 9*d* which rest on guide rails 8. This will move the gimbal device 10 and casting tube 7 away from the pouring spout 6. This will destroy the mortar seal between elements 6, 7, and suspension pins 10*a* of the gimbal device 10 will engage behind the recesses 9*c* of the legs of lever arm 9*a*. In the meantime, the tundish is raised until the casting tube 7 is free of ingot mold 3. The lever 9 then may be moved longitudinally of rails 8, with shaft portions 9*d* sliding thereon, and removed from the area of the spout. The worn casting tube 7 and the gimbal device 10 then may be removed from the recesses 9*c*, and a new casting tube 7 and gimbal device 10 may be positioned on lever arm 9*a*, with new sealing mortar freshly applied to seat 7*a*. Residual mortar in the meantime will have been removed from surface 6*a* of spout 6. The new casting tube then may be moved into position against the spout by a sequence of operations reverse to those described above.

Although the present invention has been described and illustrated with respect to a preferred embodiment thereof, it is to be understood that various modifications and changes may be made to the specifically described and illustrated structure without departing from the scope of the present invention.

We claim:

1. An apparatus for replaceably connecting a casting tube to a closable pouring spout of a tundish of a continuous casting plant, particularly for the continuous casting of bars of small cross section, wherein the casting tube extends into a permanent ingot mold to maintain molten metal being discharged from the pouring spout out of contact with the surrounding air, said apparatus comprising:

a gimbal device for supporting the casting tube;

a double-arm lever including a first arm supporting said gimbal device and a second arm carrying a counterweight;

pivot means for supporting said lever such that said counterweight pivots said lever about an axis and causes said first arm and said gimbal device to press the casting tube against the mouth of the pouring spout, said pivot means comprising support means adapted to be fixed to the tundish, said support means having therein first slots elongated in directions transverse to said axis and said lever having associated therewith a second slot elongated in a direction transverse to said axis and generally orthogonal to said directions of elongation of said first slots in said support means, a pin member defining said axis, and mounting means for moving said pin member between an operative position extending through said first and second slots and pivotally supporting said lever on said support means and an inoperative position whereat said lever is released from said support means; and lock means for holding said pin member in said operative position.

2. An apparatus as claimed in claim 1, wherein said support means comprises a pair of plate-like supports to be fixed to the tundish and to extend therefrom in spaced parallel relationship, each said plate-like support having therein a respective said first slot.

3. An apparatus as claimed in claim 2, further comprising a bearing member fixed to said lever and having therethrough said second slot, said bearing member being positioned between said plate-like supports when said pin member is in said operative position thereof.

4. An apparatus as claimed in claim 2, wherein said mounting means comprises a trolley member connected to said pin member and mounted for movement in directions parallel to said axis toward and away from said plate-like supports.

5. An apparatus as claimed in claim 4, wherein said trolley member comprises a plate member adapted to be suspended from the tundish by rollers moving on guide rails extending parallel to said axis.

6. An apparatus as claimed in claim 5, further comprising a handle extending from said plate member for enabling manual movement thereof along said guide rails.

7. An apparatus as claimed in claim 5, wherein said plate member has therein an orifice, and further comprising bolt means extending through said orifice for removably connecting said pin member to said plate member.

8. An apparatus as claimed in claim 7, wherein said orifice in said plate member comprises a third slot elongated in a direction parallel to the directions of elongation of said first slots.

9. An apparatus as claimed in claim 8, wherein said pin member has an integral forked head portion having a pair of legs extending along opposite sides of said plate member, said bolt means extending through said legs and said third slot, said head portion being guided along an end face of said plate member.

10. An apparatus as claimed in claim 9, wherein said head portion abuts one said plate-like support when said pin member is in said operative position thereof.

11. An apparatus as claimed in claim 10, wherein said pin member includes an end portion opposite said head portion, said end portion extending beyond the other said plate-like support when said pin member is in said operative position thereof, and said lock means comprises a fourth slot extending through said end portion, and a key member to be driven into said fourth slot and wedged between said pin member and said other plate-like support.

12. An apparatus for replaceably connecting a casting tube to a closable pouring spout of a tundish of a continuous casting plant, particularly for the continuous casting of bars of small cross section, wherein the casting tube extends into a permanent ingot mold to maintain molten metal being discharged from the pouring spout out of contact with the surrounding air, said apparatus comprising:

a gimbal device for supporting the casting tube;

a double-arm lever including a first arm supporting said gimbal device and a second arm carrying a counterweight;

pivot means for supporting said lever such that said counterweight pivots said lever about an axis and causes said first arm and said gimbal device to press the casting tube against the mouth of the pouring spout, said pivot means comprising support means adapted to be fixed to the tundish, a pin member defining said axis, and mounting means for moving said pin member between an operative position pivotally supporting said lever on said support means and an inoperative position whereat said lever is released from said support means;

lock means for holding said pin member in said operative position; and means for, upon said pin member being in said inoperative position thereof, enabling said second arm of said lever to be pivoted against the force of said counterweight, such that said first arm and said gimbal device are moved away from the pouring spout, whereby a spent casting tube may be removed and/or a new casting tube may be installed, said enabling means comprising parallel guide rails adapted to be fixed to the tundish on opposite sides of the pouring spout, and shaft means, extending transversely of said lever at a location on the pivot means side of said gimbal device, for supporting said lever on said guide rails for longitudinal movement therealong, said shaft means defining a pivot axis for pivoting of said second arm against said counterweight.

13. An apparatus as claimed in claim 12, wherein said second arm comprises a forked structure having a pair of spaced parallel legs extending on opposite sides of and supporting said gimbal device, and said shaft means comprises shaft portions extending outwardly from respective said legs to respective said guide rails.

* * * * *